United States Patent [19]

Greathouse

[11] Patent Number: 4,915,522

[45] Date of Patent: Apr. 10, 1990

[54] VIDEO TAPE LOG DEVICE

[76] Inventor: David P. Greathouse, 13961 Tucker Ave., Sylmar, Calif. 91342

[21] Appl. No.: 242,587

[22] Filed: Sep. 12, 1988

[51] Int. Cl.[4] ..... B42F 13/00

[52] U.S. Cl. ..... 402/79; 281/38; 281/15.1; 402/80 R; 283/63.1

[58] Field of Search ..... 281/51, 38, 15.1; 283/117, 81, 63.1; 402/79, 80 R, 80 P, 70–78

[56] References Cited

U.S. PATENT DOCUMENTS

| | | | |
|---|---|---|---|
| 4,589,685 | 5/1986 | Lazar | 283/81 |
| 4,704,042 | 11/1987 | Eisen et al. | 281/38 X |
| 4,824,273 | 4/1989 | Silva et al. | 402/79 |

FOREIGN PATENT DOCUMENTS

| | | | |
|---|---|---|---|
| 645729 | 7/1962 | Canada | 402/79 |
| 256346 | 2/1988 | European Pat. Off: | 402/79 |

*Primary Examiner*—Paul A. Bell
*Attorney, Agent, or Firm*—John J. Posta, Jr.

[57] ABSTRACT

The video tape log device includes a looseleaf binder with front and back covers connected to a page holder bearing a longitudinal spine and transverse page connectors in the form of openable rings or clips. The device also includes a plurality of pages, each being encased in plastic which can be marked and erased. The pages bear on both sides indicia in the form of marked columns for entering information identifying the particular tape involved and the segments of the tape by a condition code, by the segment title and by the position of the segment on the tape. The pages can also be colored or bear colored tabs to distinguish types of entries on the tape; for example, different types of movies. Moreover, the device can include a removable ink pen and an eraser, and, if desired, for a more permanent record, an indelible ink pen, and solvent to remove the ink, as well as a solvent applicator. Those items can be disposed in recessed pockets in one or both binder covers for ready access by the log user. The device is simple, compact, inexpensive, durable and efficient.

18 Claims, 1 Drawing Sheet

VIDEO TAPE LOG DEVICE

BACKGROUND OF THE INVENTION

1. Field of the Invention

The present invention generally relates to logs and, more particularly, to a video tape log device of an improved type.

2. Prior Art

Video tapes are used to record movies, sports events and the like by video tape recorders from television sets, other video tape recorders and the like. Since the tapes usually play for a number of hours, more than one event is usually recorded on each video tape. When a particular event is to be replayed on the tape, the user must either remember the location of the event on the tape or search for it by playing portions of the tape through. This latter procedure is time-consuming. Moreover, once an extensive number of video tapes are filled with movies and other recorded events, it becomes difficult to find them or even to remember what is available to play by video tape.

Accordingly, there is a need for an improved way of keeping track of video tapes and their recorded segments for easy and rapid replay when desired. Such device should be simple, inexpensive and capable of identifying the type, location and condition of the segment on the tape so that the segment can be easily located for replay and can be noted for reworking so that it can be replaced, transferred or edited, as desired, when the tape user wishes to up-date his or her tapes.

SUMMARY OF THE INVENTION

The improved video tape log device of the present invention satisfies all the foregoing needs. The log device is substantially as set forth in the Abstract of the Disclosure. Thus, it includes a looseleaf binder and replaceable plastic-encased pages. The pages bear indicia in the form of spaced marked columns for the entry of information on the plastic surface of the pages, title and location of segments of various tapes for easy retrieval and reworking of the tape segments. The pages may be in various colors or bear colored tabs to indicate different types of tape and tape segments, such as those bearing recorded mystery movies, comedies, horror movies and the like.

Moreover, the device can include a removable ink pen and eraser for temporarily marking the plastic coating over the columns, and/or an indelible ink pen, solvent and solvent applicator for more permanent marking of the plastic coating on the pages. The pens, eraser, solvent and applicator can be in recessed pockets in one or both binder covers for easy access.

Various other features of the improved log device of the present invention are set forth in the following detailed description and accompanying drawings.

DRAWINGS

FIG. 1 is a schematic top plan view of a first preferred embodiment of the improved video tape log device of the present invention, shown with the device opened and the pages therein exposed; and, FIG. 2 is a schematic top plan view of a second preferred embodiment of the improved video tape log device of the present invention, shown opened to the first page therein, with the recessed pens, eraser, solvent and applicator disposed in the cover thereof.

DETAILED DESCRIPTION

FIG. 1

Figure 1:
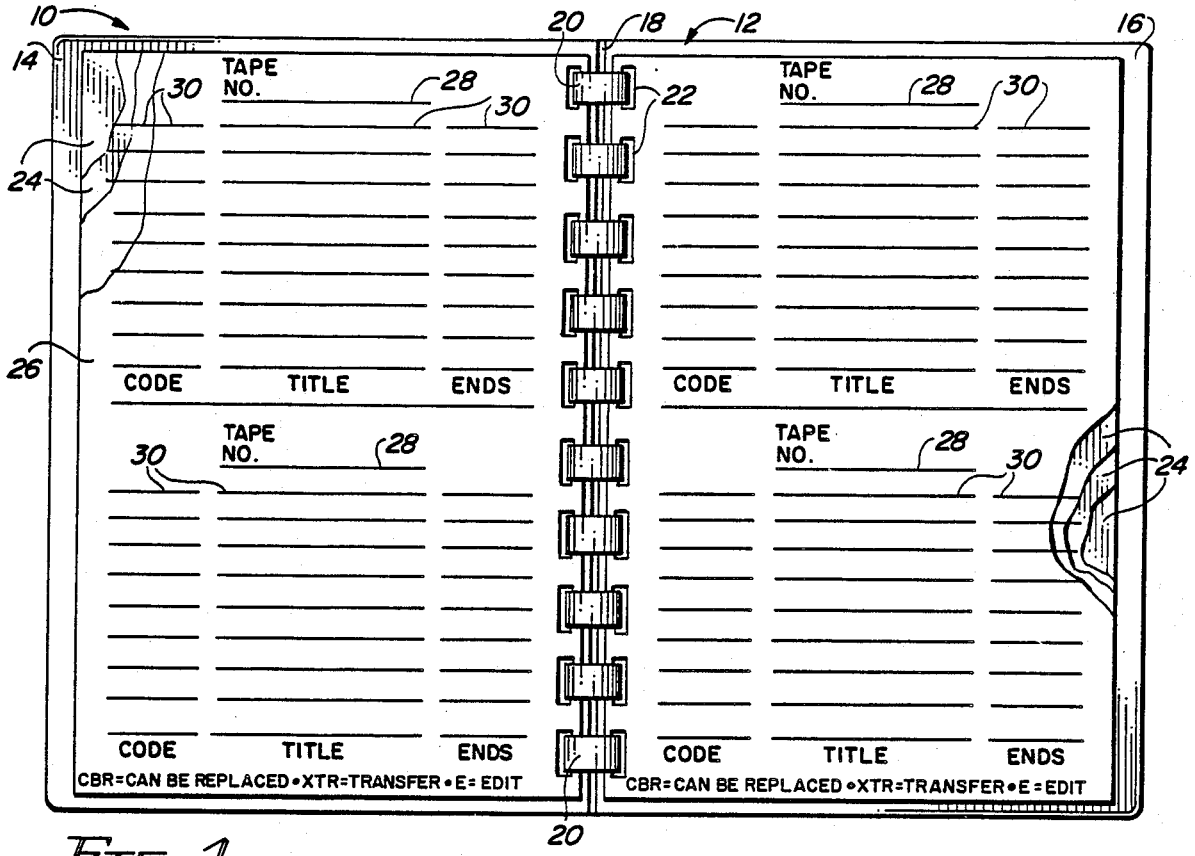

Now referring more particularly to FIG. 1 of the accompanying drawings, a first preferred embodiment of the improved video tape log device of the present invention is schematically depicted in top plan view. Thus, device 10 is shown which comprises a looseleaf binder 12 having a front cover 14 and back cover 16 of paper, paperboard, plastic, wood, metal or the like connected to a page holder in the form of a longitudinal plastic or metal spine 18 bearing integral, spaced, transversed, flexible, openable plastic split ring grips 20 down the length thereof.

Grips 20 pass through openings 22 in one side margin of each of covers 14 and 16, as well as openings 22 in a plurality of detachable pages 24. Thus, grips 20 hold covers 14 and 16 and pages 24 releasably in place but permit them to be opened and replaced. Pages 24 are encased in transparent plastic sheets 26 which covers opposite sides of pages 24 and the edges thereof. Sheets 26 can be, for example, of polyethylene, polyvinyl chloride or other clear, flexible, resilient plastic capable of being marked by removable or indelible ink, or by crayons, etc., and capable of being readily wiped free of removable ink, crayons, etc., without injury to the plastic.

Pages 24 bear printed indicia for the entry of information on sheets 26 identifying the particular video tape and tape segments on that tape, the title and position of the segments and the condition thereof. For this purpose, the upper half and bottom half of each page 24 bears a line 28 bearing the legend "tape #", for identifying the tape involved, below which are positioned three spaced columns 30 of lines bearing, respectively, the legends "code", "title" and "ends". Thus, the title of each segment can be entered on sheet 26 at the appropriate line in column 30 in erasable or indelible ink or the like as can the position where the segment ends on the tape.

At the bottom of each page 24 the "code" is identified by the abbreviations "CBR" for "can be replaced", XTR for "transfer" and "E" for "edit", in each instance indicating the condition of the segment and what needs to be done with the segment. This information is to be entered on sheet 26 by ink, crayon or the like of the appropriate line of a column 30 marked "code". In this manner, a full and accurate record of the contents of each video tape can be entered on each sheet 26 and can be removed therefrom and changed as need to up-date the tape.

As a further aid in identifying the particular tapes, pages 24 can be of different colors to, for example, indicate various types of events recorded on the tapes. For example, a red tinted page 24 can be used to indicate that the tape contains only horror films. A green page 24 might be used to indicate mystery films, a yellow page 24 might be used to indicate film comedies and a pink page 24 romantic films or x-rated films. Thus, additional information can be conveyed by color to further increase the utility of device 10. It will be understood that, if desired, sheets 26 can be colored instead of or in addition to pages 24. Device 10 is simple, durable, inexpensive and efficient.

FIG. 2

Figure 2:
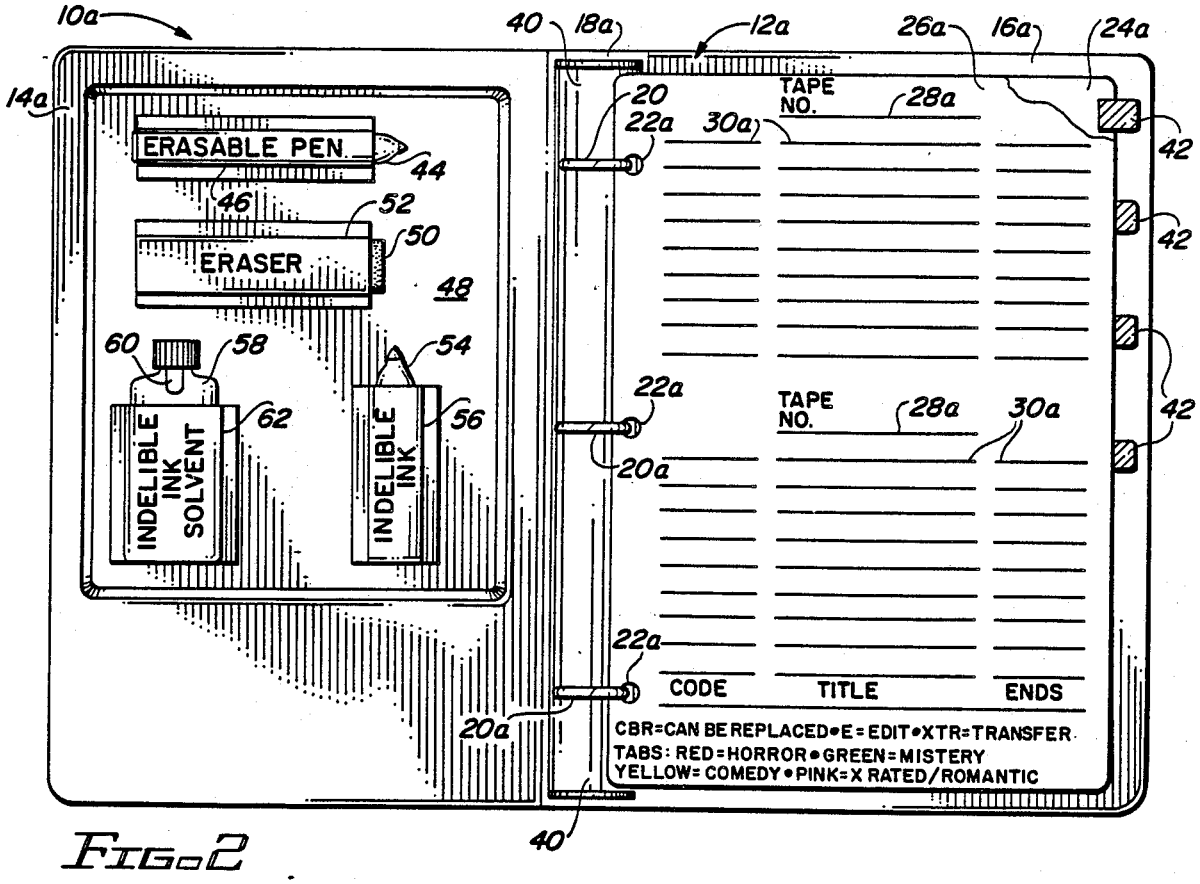

A second preferred embodiment of the improved video tape log device of the present invention is schematically depicted in top plan view in FIG. 2. Thus, device 10a is shown. Components of device 10a similar to those of device 10 bears the same numerals, but are succeeded by the letter "*a*".

Device 10a is substantially identical to device 10, except as follows:

(a) spine 18a is metal and connected to a block piece 40 which is integral with front cover 14a and back cover 16a, and bears three integral, spaced, transverse, apendable metal rings 20a;

(b) various of the pages 24a and/or sheets 26a bear different colored tabs 42 which indicate the type of tape content for the tapes listed on the tabbed pages. Moreover, the indicia at the bottom of pages 24a include a listing of the meaning of the colors of tabs 42, e.g., "Tabs: Red=Horror; Green=Mystery; Yellow=Comedy; Pink=x -rated or romantic".

(c) a removable ink pen 44 is disposed in a pocket 46 in a recessed portion 48 on the inside of front cover 14a;

(d) an eraser 50 for the ink of pen 44 is disposed in a pcoket 52 in portion 48;

(e) an indelible ink pen 54 for more permanent recording on sheets 26a and pages 24a is disposed in a pocket 56 in portion 48; and, (f) a bottle of solvent 58 for the indelible ink of pen 54 is disposed along with an integral applicator 60 in a pocket 62 in portion 48. Solvent 58 is carefully selected so that it dissolves only the ink of pen 54 and not plastic sheet 26a.

Device 10a is compact, inexpensive and efficient. It also has the other advantages of device 10. Various modifications, changes, alerations and additions can be made in the improved video tape log device of the present invention, its components and their parameters. All such changes, modifications, alterations and additions as are within the scope of the appended claims form part of the present invention.

What is claimed is:

1. An improved video tape log device, said log device comprising, in combination:

(a) a looseleaf binder having a pair of covers connected to a page holder; and, (b) a plurality of pages detachable from said page holder, both opposite sides of each said page being encased in transparent plastic upon which removable indicia can be disposed, each said page bearing printed indicia for identifying the particular tape and a plurality of tape segments on such tape.

2. The improved video tape log device of claim 1 wherein said indicia include a plurality of columns of spaced lines with indicia labeling said columns as, respectively, for identifying said video tape segments by code, title and position where the segments end.

3. The improved video tape log device of claim 2 wherein said code is specified on each said page as including the condition of a tape segment by abbreviations indicating that the segment can be replaced (CBR), the segment can be transferred (XTR) or the segment can be edited (E).

4. The improved video tape log device of claim 1 wherein said page holder includes a longitudinal spine with a plurality of integral spaced transverse openable plastic page connectors connected to said spine and fitting openings in one margin of each said page and binder covers.

5. The improved video tape log device of claim 1 wherein said page holder includes a longitudinal metallic spine with a plurality of spaced transverse openable metal rings connected thereto and passing through openings in one margin of each said page and wherein said pages bear different colors to indicate different types of video tape segments.

6. The improved video tape log device of claim 1 wherein said indicia include a plurality of columns of spaced lines with indicia labeling said columns as, respectively, for identifying said video tape segments by code, title and position where the segments end.

7. The improved video tape log device of claim 6 wherein said code is specified on each said page as including the condition of a tape segment by abbreviations indicating that the segment can be replaced (CBR), the segment can be transferred (XTR) or the segment can be edited (E).

8. The improved video tape log device of claim 1 wherein said device includes a removable ink pen and eraser.

9. The improved video tape log device of claim 8 wherein said device includes an indelible ink pen, solvent and solvent applicator for said indelible ink.

10. The improved video tape log device of claim 9 wherein said pens, eraser, solvent and applicator are disposed in recessed pockets on at least one of said covers of said binder.

11. The improved video tape log device of claim 1 wherein said pages bear colored tabs and indicia identifying the colors of said tabs as different types of video tape movies.

12. An improved data recording device comprising, in combination:

(a) a binder adapter to secure a plurality of pages by a page holder, (b) a page holder, (c) a plurality of pages detachably secured to said page holder, (d) transparent plastic sheets overlaying each of said pages, (e) said plastic sheets bearing erasable printed indicia thereon for identifying the particular type of recording device and the particular segments of data recorded on such recording device.

13. The improved video tape log device of claim 12 wherein said page holder includes a longitudinal spine with a plurality of integral spaced transverse openable plastic page connectors connected to said spine and fitting openings in one margin of each said page and binder covers.

14. The improved video tape log device of claim 12 wherein said page holder includes a longitudinal metallic spine with a plurality of spaced transverse openable metal rings connected thereto and passing through openings in one margin of each said page and wherein said pages bear different colors to indicate different types of video tape segments.

15. The improved video tape log device of claim 12 wherein said device includes an erasable ink pen and eraser.

16. The improved video tape log device of claim 15 wherein said device includes an indelible ink pen, solvent and solvent applicator for said indelible ink.

17. The improved video tape log device of claim 16 wherein said pens, eraser, solvent and applicator are disposed in recessed pockets on at least one of said covers of said binder.

18. The improved video tape log device of claim 10 wherein said pages bear colored tabs and indicia identifying the colors of said tabs as different types of video tape movies.

* * * * *